United States Patent [19]

Schat et al.

[11] 4,001,625

[45] Jan. 4, 1977

[54] HIGH-PRESSURE DISCHARGE LAMP HAVING A METAL LEAD THROUGH CONDUCTOR

[75] Inventors: Bralt Renze Schat; Abraham Timmermans, both of Eindhoven, Netherlands

[73] Assignee: U. S. Philips Corporation, New York, N.Y.

[22] Filed: Oct. 15, 1974

[21] Appl. No.: 514,740

Related U.S. Application Data

[63] Continuation of Ser. No. 332,120, Feb. 13, 1973, abandoned.

[30] Foreign Application Priority Data

Feb. 21, 1972 Netherlands ..... 7202270

[52] U.S. Cl. ..... 313/220; 313/221; 313/318

[51] Int. Cl.[2] ..... H01J 61/30; H01J 61/36

[58] Field of Search ..... 313/220, 221, 184, 318; 52/759

[56] References Cited

UNITED STATES PATENTS

| | | | |
|---|---|---|---|
| 3,363,134 | 1/1968 | Johnson | 313/220 |
| 3,436,109 | 4/1969 | Loose | 52/759 |
| 3,659,138 | 4/1972 | Johnson et al. | 313/317 |
| 3,716,743 | 2/1973 | Mizuno et al. | 313/220 |
| 3,742,283 | 6/1973 | Loughridge | 313/318 |

FOREIGN PATENTS OR APPLICATIONS

| | | | |
|---|---|---|---|
| 2,032,277 | 12/1971 | Germany | 313/220 |

*Primary Examiner*—Palmer C. Demeo
*Attorney, Agent, or Firm*—Frank R. Trifari; Robert S. Smith

[57] ABSTRACT

A discharge vessel is closed with the aid of a stud of molybdenum/aluminum-oxide cermet through which an electrical tubular lead-through of molybdenum projects. The cermet stud and the molybdenum tube constitute a gastight connection without the interposition of a melting glass.

4 Claims, 1 Drawing Figure

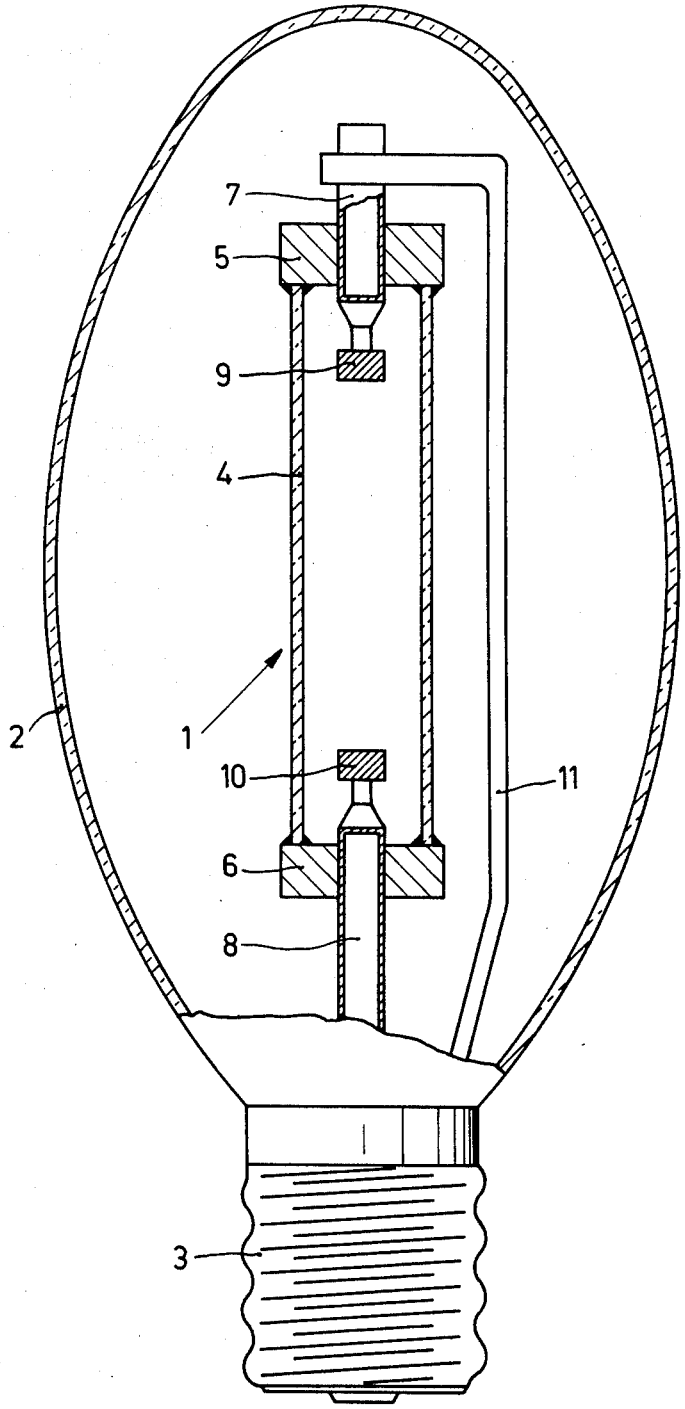
7
5
9
4
2
1
10
11
6
8
3

HIGH-PRESSURE DISCHARGE LAMP HAVING A METAL LEAD THROUGH CONDUCTOR

This is a continuation of application Ser. No. 332,120, filed Feb. 13, 1973, now abandoned.

The invention relates to a high-pressure discharge lamp provided with a discharge vessel in which the wall of the vessel consists largely of aluminium oxide in at least a single location and in which the current is applied to an electrode in the discharge vessel through a metal lead-through conductor which is located near the wall-location largely consisting of aluminium oxide, the lead-through conductor passing through a closing member of the discharge vessel which member consists at least partly of aluminium oxide.

A high-pressure discharge lamp of the kind referred to is known, for example, from German Offenlegungsschrift No. 1,471,379. A drawback of this known lamp is the necessity of using melting glass between the lead-through conductor and the closing member consisting at least partly of aluminium oxide of the discharge vessel.

An object of the invention is to provide a simpler closure of a discharge tube of a high-pressure discharge lamp of the kind described in the preamble in which melting glass around the lead-through conductor is not necessary.

According to the invention, a high-pressure discharge lamp provided with a discharge vessel in which the wall of the vessel consists largely of aluminium oxide in at least a single location and in which the current is applied to an electrode in the discharge vessel through a metal lead-through conductor which is located near the wall-location largely consisting of aluminium oxide, and in which the lead-through conductor passes through a closing member of the discharge vessel, which member consists at least partly of aluminium oxide is characterized in that the material of the closing member of the discharge vessel is an aluminium-oxide cermet, which cermet is in direct mechanical contact with the metal of the lead-through conductor, the value of the coefficient of expansion of the aluminium-oxide cermet being between that of the material of the adjacent wall-location largely consisting of aluminium oxide and that of the metal of the lead-through conductor.

Cermet is understood to mean a refractory material consisting of a heterogeneous combination of one or more metals and/or alloys having one or more ceramic phases.

An advantage of this lamp is that the closure of the discharge tube is very simple. Melting glass around the lead-through conductor is in fact no longer necessary.

As is common practice in connections of different materials, the coefficients of expansion of adjacent materials should not have too large differences. In the relevant case this applies both to the connection between the cermet and the wall of the vessel and to the connection between the cermet and the metal lead-through conductor. In the case of rod-shaped lead-through conductors it is found that the admissible difference in the coefficient of expansion relative to the cermet is generally smaller than in the case of tubular metal lead-through conductors. In the case of a rod-shaped lead-through conductor this admissible difference in coefficient of expansion is of the order of $1.10^{-6}/°$ C. Other factors such as the ductility of the material of the lead-through conductor are important for the admissible difference in coefficient of expansion.

The aluminium-oxide cermet preferably includes a metal X in a high-pressure discharge lamp according to the invention and the lead-through conductor largely consists of the metal X.

An advantage of this preferred embodiment is that a very satisfactory gastight connection between the lead-through conductor and the cermet can be obtained because an intimate contact can be established between the metal of the lead-through conductor and the metal phase of the cermet.

The metal X may be, for example, iron.

The metal X is preferably molybdenum. An advantage thereof is that the difference in coefficient of expansion between the lead-through conductor and the cermet may be very small. A further advantage of this preferred embodiment is that the said closure may alternatively be used for a high-pressure discharge lamp including halides.

The invention will be described in greater detail with reference to a drawing. This drawing shows a high-pressure discharge lamp according to the invention.

The lamp shown is a high-pressure sodium vapour discharge lamp of approximately 400 Watts whose discharge vessel is denoted by 1. This discharge vessel is surrounded by an outer envelope 2. 3 denotes a lamp cap.

The discharge vessel 1 has a cylindrical wall 4 consisting of densely sintered (polycrystalline) aluminium oxide. This wall may alternatively consist of, for example, saphire. The discharge vessel 1 is closed by means of two cylindrical studs 5 and 6 of a molybdenum-/aluminium-oxide cermet in a volume ratio of 34:66. The studs 5 and 6 are secured to the ends of the wall 4 of the discharge vessel by means of melting glass. A molybdenum tube 7 serves as a lead-through conductor through stud 5. A lead-through conductor consisting of a molybdenum tube 8 likewise passes through stud 6. The tube 7 leads to an internal electrode 9 of the discharge vessel 1. The tube 8 leads to a second internal electrode 10 of the discharge vessel 1. 11 denotes a terminal wire which is connected to the tube 7.

The operating voltage of the lamp shown was approximately 105 volts and the lamp current was approximately 4.4 amperes. The coefficient of expansion of the tube 7 was approximately $6.10^{-6}/°$ C, that of the cermet 5 was approximately $7.10^{-6}/°$ C and that of the densely sintered aluminium oxide of the wall 4 of the discharge vessel 1 was approximately $8.10^{-6}/°$ C.

Consequently, the condition of the coefficient of expansion of the cermet being between the coefficients of expansion of the lead-through conductor 7 (8) and that of the wall 4 is satisfied. Thus, the differences between the coefficients of expansion of adjacent materials were in the relevant case approximately $1.10^{-6}/°$ C.

The tube 7 is secured to the cermet 5 in the following manner: firstly, the tube 7 was placed in a hole in a non-sintered cermet cylinder, which hole had a diameter which was 0.2 mm larger than that of the tube 7. Subsequently, sintering was effected at approximately 1600° C in a hydrogen atmosphere where after cooling to room temperature took place.

This securement yielded a gastight connection, so that the complication of a melting glass around the lead-through conductor was avoided.

Due to the coefficients of expansion deviating from each other to a slight extent, the temperature of an end of the vessel 1 could vary between approximately 0° C and approximately 750° C (the operating temperature) without attacking the adhesive gastight connection between 7 and 5, and between 8 and 6.

If desired, strips, for example, of tantalum may be provided around the ends of the wall 4 of the discharge vessel in order to increase the efficiency of the lamp.

The described embodiment related to a high-pressure sodium vapour discharge lamp. The invention is, however, also suitable for other high-pressure discharge lamps, for example, for high-pressure discharge lamps in which the discharge vessel contains a gas, for example, xenon or the metal mercury and one or more halides.

What is claimed is:

1. A discharge lamp which comprises: an elongated generally tubular discharge tube formed of a material which is primarily aluminum oxide; a pair of disc-shaped closure members disposed at each end of said tube, each of said closure members having a passageway therethrough and being formed of an aluminum oxide cermet; a pair of generally tubular lead-through conductors disposed in axially aligned relationship, each extending through said closure members, said cermet having a coefficient of thermal expansion intermediate the coefficient of thermal expansion of said conductors and said discharge tube, said discharge tube conductors being disposed in sealing engagement directly with said closure member.

2. Apparatus as described in claim 1, wherein each of said conductors are composed of a metal selected from the group which consists of molybdenum and iron and wherein said aluminum oxide cermet includes the same metal.

3. Apparatus as described in claim 1, wherein said electrode is molybdenum and said aluminum oxide cermet includes molybdenum.

4. The apparatus as described in claim 3, wherein said closure member consists of an aluminum oxide cermet containing molybdenum in a volume ratio of molybdenum to aluminum oxide of approximately 34:66.

* * * * *